US009434900B2

(12) United States Patent
Brewer et al.

(10) Patent No.: US 9,434,900 B2
(45) Date of Patent: Sep. 6, 2016

(54) LIQUID FUEL COMPOSITIONS

(71) Applicant: SHELL OIL COMPANY, Houston, TX (US)

(72) Inventors: Mark Lawrence Brewer, Manchester (GB); Michael William Howe, Spring, TX (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 14/835,886

(22) Filed: Aug. 26, 2015

(65) Prior Publication Data

US 2015/0361366 A1 Dec. 17, 2015

Related U.S. Application Data

(62) Division of application No. 14/134,804, filed on Dec. 19, 2013, now abandoned.

(60) Provisional application No. 61/740,535, filed on Dec. 21, 2012.

(51) Int. Cl.

| | |
|---|---|
| ***C10L 1/18*** | (2006.01) |
| ***C10L 1/19*** | (2006.01) |
| ***C10L 1/22*** | (2006.01) |
| ***C10L 1/185*** | (2006.01) |
| ***C10L 1/189*** | (2006.01) |
| ***C10L 1/223*** | (2006.01) |
| ***C10L 1/06*** | (2006.01) |
| ***C10L 10/00*** | (2006.01) |
| ***C10L 1/20*** | (2006.01) |
| ***C10L 1/222*** | (2006.01) |
| ***C10L 1/228*** | (2006.01) |
| ***C10L 1/24*** | (2006.01) |

(52) U.S. Cl.

CPC .. *C10L 1/22* (2013.01); *C10L 1/06* (2013.01); *C10L 1/18* (2013.01); *C10L 1/189* (2013.01); *C10L 1/1852* (2013.01); *C10L 1/1857* (2013.01); *C10L 1/19* (2013.01); *C10L 1/202* (2013.01); *C10L 1/223* (2013.01); *C10L 1/2225* (2013.01); *C10L 1/2286* (2013.01); *C10L 1/2437* (2013.01); *C10L 10/00* (2013.01); *C10L 2200/0259* (2013.01); *C10L 2200/0423* (2013.01); *C10L 2230/22* (2013.01); *C10L 2270/023* (2013.01)

(58) Field of Classification Search

CPC ..... C10L 1/22; C10L 1/18; C10L 1/2225; C10L 1/1857; C10L 1/202; C10L 1/2437; C10L 1/2286; C10L 1/19; C10L 1/189; C10L 1/1852; C10L 1/06; C10L 10/00; C10L 1/223; C10L 2230/22; C10L 2200/0423; C10L 2270/023; C10L 2200/0259

USPC ..... 424/59, 60; 585/1, 14; 123/1 A

See application file for complete search history.

(56) References Cited

U.S. PATENT DOCUMENTS

| | | | | |
|---|---|---|---|---|
| 1,975,755 | A | 10/1934 | Hoyt et al. | |
| 4,743,273 | A | 5/1988 | Croudace et al. | |
| 4,744,798 | A | 5/1988 | Andress | |
| 4,849,572 | A | 7/1989 | Chen et al. | |
| 4,877,416 | A | 10/1989 | Campbell | |
| 5,855,629 | A | 1/1999 | Grundy et al. | |
| 8,518,130 | B2 | 8/2013 | Croft et al. | |
| 8,557,001 | B2 | 10/2013 | Brewer et al. | |
| 8,709,111 | B2 | 4/2014 | Felix-Moore et al. | |
| 8,741,002 | B2 | 6/2014 | Felix-Moore et al. | |
| 2004/0067894 | A1* | 4/2004 | Carola | A61K 8/498 514/27 |
| 2007/0032581 | A1* | 2/2007 | Stoll | C08K 5/1575 524/189 |
| 2007/0257234 | A1* | 11/2007 | Gerster | C07C 9/604 252/407 |
| 2008/0236029 | A1 | 10/2008 | Wilkins | |
| 2009/0098072 | A1* | 4/2009 | Rudolph | A23L 3/3499 424/59 |
| 2010/0161029 | A1 | 6/2010 | Filippini et al. | |

FOREIGN PATENT DOCUMENTS

| | | |
|---|---|---|
| DE | 3826608 | 2/1990 |
| DE | 3838918 | 5/1990 |
| DE | 4142241 | 6/1993 |
| DE | 4309074 | 9/1994 |
| DE | 19620262 | 11/1997 |
| DE | 10102913 | 7/2002 |
| EP | 310875 | 4/1989 |
| EP | 356725 | 3/1990 |
| EP | 452328 | 3/1991 |
| EP | 548617 | 6/1993 |
| EP | 700985 | 3/1996 |
| EP | 831141 | 3/1998 |
| GB | 835800 | 5/1960 |
| WO | 9424231 | 10/1994 |
| WO | 9703946 | 2/1997 |
| WO | 03076554 | 9/2003 |
| WO | 2008126099 | 10/2008 |
| WO | 2009050287 | 4/2009 |
| WO | 2009077606 | 6/2009 |
| WO | 2010000761 | 1/2010 |
| WO | 2010028206 | 3/2010 |
| WO | 2010136436 | 12/2010 |

OTHER PUBLICATIONS

EIC STIC search Apr. 21, 2016.*

(Continued)

*Primary Examiner* — Pamela H Weiss

(57) ABSTRACT

A liquid fuel composition containing: (a) a gasoline base fuel suitable for use in an internal combustion engine; and (b) one or more organic sunscreen compounds.

6 Claims, No Drawings

(56) References Cited

OTHER PUBLICATIONS

Kalghatgi, Gautam, et al.; Octane Appetite Studies in Direct Injection Spark Ignition (DISI) Engines, 2005 SAE International 2005-01-0244.
Kalghatgi, Gautam T., Auto-Igntition Quality of Practical Fuels and Implications for Fuel Requirements of Future SI and HCCI Engines, SAE100 International World Congress, Apr. 11-14, 2005-01-0239.
Gillespie, L.L., et al.; Aspects of Laminar and Turbulent Buring Velocity Relevant to Spark Ignition Engines, Journal of the Society of Automotive Engineers(2000-01-0192), pp. 1-21, 2000.
Sagarin, et al., Cosmetics Science and Technology, Wiley-Interscience, 2nd Edition, vol. 1, pp. 189, 1972.
Cracknell, Roger, et al.; Influence of Laminar Burning Velocity on Performance of Gasoline Engines, 2012 SAE International, 2012-01-1742.

* cited by examiner

LIQUID FUEL COMPOSITIONS

This application is a divisional of U.S. Non-Provisional application Ser. No. 14/134,804, filed Dec. 19, 2013, which claims the benefit of U.S. Provisional Application No. 61/740,535, filed Dec. 21, 2012, the entire disclosure of which is incorporated herein by reference.

FIELD OF THE INVENTION

The present invention relates to a liquid fuel composition, in particular to a liquid fuel composition having improved power and/or acceleration properties. The present invention also relates to a method of improving the power and/or acceleration properties of an internal combustion engine by fuelling the internal combustion engine with the liquid fuel composition described herein below.

BACKGROUND OF THE INVENTION

Laminar burning velocity (also referred to as "flame speed") is a fundamental combustion property of any fuel/air mixture. As taught in SAE 2012-01-1742 formulating gasoline fuel blends having faster burning velocities can be an effective strategy for enhancing engine and vehicle performance. Faster burning fuels can lead to a more optimum combustion phasing resulting in a more efficient energy transfer and hence a faster acceleration and better performance.

SUMMARY OF THE INVENTION

It has now been found that the use of organic sunscreen compounds in liquid fuel compositions can provide benefits in terms of increased flame speed, improved power output and improved acceleration performance.

In one embodiment, there is provided a liquid fuel composition comprising:

(a) a gasoline base fuel suitable for use in an internal combustion engine; and (b) one or more organic sunscreen compounds.

In another embodiment, there is provided a method of improving the power output of an internal combustion engine, said method comprising fuelling the internal combustion engine containing a lubricant with a liquid fuel composition described herein below.

In yet another embodiment, there is provided a method of improving the acceleration of an internal combustion engine, said method comprising fuelling the internal combustion engine containing a lubricant with a liquid fuel composition described herein below.

In yet another embodiment, there is provided a method of increasing the flame speed of an internal combustion engine, said method comprising fuelling the internal combustion engine containing a lubricant with a liquid fuel composition described herein below.

DETAILED DESCRIPTION OF THE INVENTION

In order to assist with the understanding of the invention several terms are defined herein.

The term "power output" as used herein refers to the amount of resistance power required to maintain a fixed speed at wide open throttle conditions in Chassis Dynomometer testing.

In one embodiment, there is provided a method of improving the power output of an internal combustion engine, said method comprising fuelling the internal combustion engine containing a lubricant with a liquid fuel composition described hereinbelow. In the context of this aspect of the invention, the term "improving" embraces any degree of improvement. The improvement may for instance be 0.05% or more, preferably 0.1% or more, more preferably 0.2% or more, even more preferably 0.5% or more, especially 1% or more, more especially 2% or more, even more especially 5% or more, of the power output of an analogous fuel formulation, prior to adding one or more organic sunscreen compounds to it in accordance with the present invention. The improvement in power output may be at most 10% of the power output of an analogous fuel formulation, prior to adding one or more organic sunscreens to it in accordance with the present invention.

In accordance with the present invention, the power output provided by a fuel composition may be determined in any known manner.

The term "acceleration" as used herein refers to the amount of time required for the engine to increase in speed between two fixed speed conditions in a given gear.

In one embodiment, there is provided a method of improving the acceleration of an internal combustion engine, said method comprising fuelling the internal combustion engine containing a lubricant with a liquid fuel composition described hereinbelow. In the context of this aspect of the invention, the term "improving" embraces any degree of improvement. The improvement may for instance be 0.05% or more, preferably 0.1% or more, more preferably 0.2% or more, even more preferably 0.5% or more, especially 1% or more, more especially 2% or more and even more especially 5% or more of the acceleration provided by an analogous fuel formulation, prior to adding one or more organic sunscreen compounds to it in accordance with the present invention. The improvement in acceleration may be at most 10% of the acceleration provided by an analogous fuel formulation, prior to adding one or more organic sunscreens to it in accordance with the present invention.

In accordance with the present invention, the power output and acceleration provided by a fuel composition may be determined in any known manner for instance using the standard test methods as set out in SAE Paper 2005-01-0239 and SAE Paper 2005-01-0244.

The term "flame speed" as used herein refers to laminar burning velocity. Laminar burning velocity (SL) is a fundamental property of a chemical component. It is defined as the rate (normal to the flame front, under laminar flow conditions) at which unburnt gas propagates to the flame front and reacts to form products.

In one embodiment, there is provided a method of increasing the flame speed of an internal combustion engine, said method comprising fuelling the internal combustion engine containing a lubricant with a liquid fuel composition described herein below. In the context of this aspect of the invention, the term "increasing" embraces any degree of increase. The increase may for instance be 0.05% or more, preferably 0.1% or more, more preferably 1% or more, and especially 5% or more of the flame speed of an analogous fuel formulation, prior to adding one or more organic sunscreen compounds to it in accordance with the present invention. The increase in flame speed may be at most 10% of the flame speed of an analogous fuel formulation, prior to adding one or more organic sunscreens to it in accordance with the present invention.

In accordance with the present invention, the flame speed of a fuel composition may be determined in any known manner, for instance measurement of SL can be performed in a constant volume combustion chamber (spherical bomb), ref Gillespie, L. L., M.; Sheppard, C. G.; Wooley, R, *Aspects of laminar and turbulent burning velocity relevant to spark ignition engines*, Journal of the Society of Automotive Engineers, 2000 (2000-01-0192).

However, it should be appreciated that any measurable improvement in power output, acceleration and flame speed may provide a worthwhile advantage, depending on what other factors are considered important, e.g. availability, cost, safety and so on.

The liquid fuel composition of the present invention comprises a gasoline base fuel suitable for use in an internal combustion engine and one or more organic sunscreen compounds. Therefore the liquid fuel composition of the present invention is a gasoline composition.

There is no particular limitation on the type of organic sunscreen compound which can be used in the present invention as long as it is suitable for use in a gasoline composition.

A wide variety of conventional organic sunscreen actives are suitable for use herein. Sagarin, et al., at Chapter VIII, pages 189 et seq., of Cosmetics Science and Technology (1972), discloses numerous suitable actives. Particularly preferred hydrophobic organic sunscreen actives useful in the composition of the present invention include: (i) alkyl β,β-diphenylacrylate and/or alpha-cyano-beta,beta-diphenylacrylate derivatives; (ii) salicylic derivatives; (iii) cinnamic derivatives; (iv) dibenzoylmethane derivatives; (v) camphor derivatives; (vi) benzophenone derivatives; (vii) p-aminobenzoic acid derivatives; and (viii) phenalkyl benzoate derivatives; and mixtures thereof.

Preferred alpha-cyano-beta,beta-diphenylacrylate derivatives include ethyl 2-cyano-3,3-diphenylacrylate, 2-ethylhexyl 2-cyano-3,3-diphenylacrylate, and mixtures thereof. More preferably the alpha-cyano-beta,beta-diphenylacrylate derivative is 2-ethylhexyl 2-cyano-3,3-diphenylacrylate, of which the International Non Proprietary Name is Octocrylene. 2-ethylhexyl 2-cyano-3,3-diphenylacrylate is commercially available under the tradename Parsol 340® from DSM Nutritional Products, Inc.

Preferred salicylate derivatives include ethylhexyl salicylate (octyl salicylate), triethanolamine salicylate, 3,3,5-trimethylcyclohexylsalicylate, homomenthyl salicylate, and mixtures thereof. More preferably, the salicylate derivative is ethylhexyl salicylate. Ethylhexyl salicylate is commercially available under the tradename Parsol EHS® from DSM Nutritional Products, Inc.

Preferred cinnamic derivatives are selected from octylmethoxy cinnamate, diethanolamine methoxycinnamate, and mixtures thereof. A particularly preferred cinnamic derivative for use herein is octylmethoxy cinnamate. Octylmethoxy cinnamate is commercially available under the tradename Parsol MCX® from DSM Nutritional Products, Inc.

Preferred dibenzoylmethane derivatives for use herein are selected from butyl methoxy dibenzoylmethane, ethylhexyl methoxy dibenzoylmethane, isopropyl dibenzoylmethane, and mixtures thereof. A particularly preferred dibenzoylmethane derivative for use herein is butyl methoxy dibenzoylmethane. Butyl methoxy dibenzoylmethane is commercially available under the tradename Parsol 1789® from DSM Nutritional Products, Inc.

A preferred camphor derivative for use herein is 4-methylbenzylidene camphor. 4-methylbenzylidene camphor is commercially available under the tradename Parsol 5000® from DSM Nutritional Products, Inc.

Preferred benzophenone derivatives for use herein are selected from benzophenone-1, benzophenone-2, benzophenone-3, benzophenone-4, benzophenone-5, benzophenone-6, benzophenone-7, benzophenone-8, benzophenone-9, benzophenone-10, benzophenone-11, benzophenone-12, and mixtures thereof. A particularly preferred benzophenone derivative for use herein is benzophenone-3. Benzophenone-3 is commercially available under the tradename Escalol 567® from Ashland Specialty Ingredients.

A preferred phenalkyl benzoate derivatives for use herein is phenethyl benzoate. Phenethyl benzoate is commercially available under the tradename X-tend 229® from Ashland Specialty Ingredients.

The total level of the one or more organic sunscreen compounds is preferably at most 2 wt %, by weight of the liquid fuel composition. The total level of the one or more organic sunscreen compounds is preferably at least 10 ppmw, by weight of the liquid fuel composition. The total level of the one or more organic sunscreen compositions is preferably in the range of from 1 wt % to 0.005 wt %, more preferably in the range of from 0.5 wt % to 0.01 wt %, even more preferably in the range of from 0.05 wt % to 0.01 wt %, by weight of the liquid fuel composition.

The organic sunscreen compound may be blended together with any other additives e.g. additive performance package(s) to produce an additive blend. The additive blend is then added to a base fuel to produce a liquid fuel composition. The amount of organic sunscreen in the additive blend is preferably in the range of from 0.1 to 99.8 wt %, more preferably in the range of from 5 to 50 wt %, by weight of the additive blend.

The amount of performance package(s) in the additive blend is preferably in the range of from 0.1 to 99.8 wt %, more preferably in the range of from 5 to 50 wt %, by weight of the additive blend.

Preferably, the amount of the performance package present in the liquid fuel composition of the present invention is in the range of 15 ppmw (parts per million by weight) to 10% wt, based on the overall weight of the liquid fuel composition. More preferably, the amount of the performance package present in the liquid fuel composition of the present invention additionally accords with one or more of the parameters (i) to (xv) listed below:

(i) at least 100 ppmw
(ii) at least 200 ppmw
(iii) at least 300 ppmw
(iv) at least 400 ppmw
(v) at least 500 ppmw
(vi) at least 600 ppmw
(vii) at least 700 ppmw
(viii) at least 800 ppmw
(ix) at least 900 ppmw
(x) at least 1000 ppmw
(xi) at least 2500 ppmw
(xii) at most 5000 ppmw
(xiii) at most 10000 ppmw
(xiv) at most 2% wt.
(xv) at most 5% wt.

In the liquid fuel compositions of the present invention, the gasoline may be any gasoline suitable for use in an internal combustion engine of the spark-ignition (petrol) type known in the art, including automotive engines as well as in other types of engine such as, for example, off road and aviation engines. The gasoline used as the base fuel in the liquid fuel composition of the present invention may conveniently also be referred to as 'base gasoline'.

Gasolines typically comprise mixtures of hydrocarbons boiling in the range from 25 to 230° C. (EN-ISO 3405), the optimal ranges and distillation curves typically varying according to climate and season of the year. The hydrocarbons in a gasoline may be derived by any means known in the art, conveniently the hydrocarbons may be derived in any known manner from straight-run gasoline, synthetically-produced aromatic hydrocarbon mixtures, thermally or catalytically cracked hydrocarbons, hydro-cracked petroleum fractions, catalytically reformed hydrocarbons or mixtures of these.

The specific distillation curve, hydrocarbon composition, research octane number (RON) and motor octane number (MON) of the gasoline are not critical.

Conveniently, the research octane number (RON) of the gasoline may be at least 80, for instance in the range of from 80 to 110, preferably the RON of the gasoline will be at least 90, for instance in the range of from 90 to 110, more preferably the RON of the gasoline will be at least 91, for instance in the range of from 91 to 105, even more preferably the RON of the gasoline will be at least 92, for instance in the range of from 92 to 103, even more preferably the RON of the gasoline will be at least 93, for instance in the range of from 93 to 102, and most preferably the RON of the gasoline will be at least 94, for instance in the range of from 94 to 100 (EN 25164); the motor octane number (MON) of the gasoline may conveniently be at least 70, for instance in the range of from 70 to 110, preferably the MON of the gasoline will be at least 75, for instance in the range of from 75 to 105, more preferably the MON of the gasoline will be at least 80, for instance in the range of from 80 to 100, most preferably the MON of the gasoline will be at least 82, for instance in the range of from 82 to 95 (EN 25163).

Typically, gasolines comprise components selected from one or more of the following groups; saturated hydrocarbons, olefinic hydrocarbons, aromatic hydrocarbons, and oxygenated hydrocarbons. Conveniently, the gasoline may comprise a mixture of saturated hydrocarbons, olefinic hydrocarbons, aromatic hydrocarbons, and, optionally, oxygenated hydrocarbons.

Typically, the olefinic hydrocarbon content of the gasoline is in the range of from 0 to 40 percent by volume based on the gasoline (ASTM D1319); preferably, the olefinic hydrocarbon content of the gasoline is in the range of from 0 to 30 percent by volume based on the gasoline, more preferably, the olefinic hydrocarbon content of the gasoline is in the range of from 0 to 20 percent by volume based on the gasoline.

Typically, the aromatic hydrocarbon content of the gasoline is in the range of from 0 to 70 percent by volume based on the gasoline (ASTM D1319), for instance the aromatic hydrocarbon content of the gasoline is in the range of from 10 to 60 percent by volume based on the gasoline; preferably, the aromatic hydrocarbon content of the gasoline is in the range of from 0 to 50 percent by volume based on the gasoline, for instance the aromatic hydrocarbon content of the gasoline is in the range of from 10 to 50 percent by volume based on the gasoline.

The benzene content of the gasoline is at most 10 percent by volume, more preferably at most 5 percent by volume, especially at most 1 percent by volume based on the gasoline.

The gasoline preferably has a low or ultra low sulphur content, for instance at most 1000 ppmw (parts per million by weight), preferably no more than 500 ppmw, more preferably no more than 100, even more preferably no more than 50 and most preferably no more than even 10 ppmw.

The gasoline also preferably has a low total lead content, such as at most 0.005 g/l, most preferably being lead free—having no lead compounds added thereto (i.e. unleaded).

When the gasoline comprises oxygenated hydrocarbons, at least a portion of non-oxygenated hydrocarbons will be substituted for oxygenated hydrocarbons. The oxygen content of the gasoline may be up to 35 percent by weight (EN 1601) (e.g. ethanol per se) based on the gasoline. For example, the oxygen content of the gasoline may be up to 25 percent by weight, preferably up to 10 percent by weight. Conveniently, the oxygenate concentration will have a minimum concentration selected from any one of 0, 0.2, 0.4, 0.6, 0.8, 1.0, and 1.2 percent by weight, and a maximum concentration selected from any one of 5, 4.5, 4.0, 3.5, 3.0, and 2.7 percent by weight.

Examples of oxygenated hydrocarbons that may be incorporated into the gasoline include alcohols, ethers, esters, ketones, aldehydes, carboxylic acids and their derivatives, and oxygen containing heterocyclic compounds. Preferably, the oxygenated hydrocarbons that may be incorporated into the gasoline are selected from alcohols (such as methanol, ethanol, propanol, 2-propanol, butanol, tert-butanol, isobutanol and 2-butanol), ethers (preferably ethers containing 5 or more carbon atoms per molecule, e.g., methyl tert-butyl ether and ethyl tert-butyl ether) and esters (preferably esters containing 5 or more carbon atoms per molecule); a particularly preferred oxygenated hydrocarbon is ethanol.

When oxygenated hydrocarbons are present in the gasoline, the amount of oxygenated hydrocarbons in the gasoline may vary over a wide range. For example, gasolines comprising a major proportion of oxygenated hydrocarbons are currently commercially available in countries such as Brazil and U.S.A., e.g. ethanol per se and E85, as well as gasolines comprising a minor proportion of oxygenated hydrocarbons, e.g. E10 and E5. Therefore, the gasoline may contain up to 100 percent by volume oxygenated hydrocarbons. E100 fuels as used in Brazil are also included herein. Preferably, the amount of oxygenated hydrocarbons present in the gasoline is selected from one of the following amounts: up to 85 percent by volume; up to 70 percent by volume; up to 65 percent by volume; up to 30 percent by volume; up to 20 percent by volume; up to 15 percent by volume; and, up to 10 percent by volume, depending upon the desired final formulation of the gasoline. Conveniently, the gasoline may contain at least 0.5, 1.0 or 2.0 percent by volume oxygenated hydrocarbons.

Examples of suitable gasolines include gasolines which have an olefinic hydrocarbon content of from 0 to 20 percent by volume (ASTM D1319), an oxygen content of from 0 to 5 percent by weight (EN 1601), an aromatic hydrocarbon content of from 0 to 50 percent by volume (ASTM D1319) and a benzene content of at most 1 percent by volume.

Also suitable for use herein are gasoline blending components which can be derived from a biological source. Examples of such gasoline blending components can be found in WO2009/077606, WO2010/028206, WO2010/000761, European patent application nos. 09160983.4, 09176879.6, 09180904.6, and U.S. patent application Ser. No. 61/312,307.

Whilst not critical to the present invention, the base gasoline or the gasoline composition of the present invention may conveniently include one or more optional fuel additives, in addition to the essential one or more organic sunscreen compounds mentioned above. The concentration and nature of the optional fuel additive(s) that may be included in the base gasoline or the gasoline composition of the present invention is not critical. Non-limiting examples of suitable types of fuel additives that can be included in the base gasoline or the gasoline composition of the present invention include anti-oxidants, corrosion inhibitors, detergents, dehazers, antiknock additives, metal deactivators, valve-seat recession protectant compounds, dyes, solvents, carrier fluids, diluents and markers. Examples of suitable such additives are described generally in U.S. Pat. No. 5,855,629.

Conveniently, the fuel additives can be blended with one or more solvents to form an additive concentrate, the additive concentrate can then be admixed with the base gasoline or the gasoline composition of the present invention.

The (active matter) concentration of any optional additives present in the base gasoline or the gasoline composition of the present invention is preferably up to 1 percent by weight, more preferably in the range from 5 to 2000 ppmw, advantageously in the range of from 300 to 1500 ppmw, such as from 300 to 1000 ppmw.

As stated above, the gasoline composition may also contain synthetic or mineral carrier oils and/or solvents.

Examples of suitable mineral carrier oils are fractions obtained in crude oil processing, such as brightstock or base oils having viscosities, for example, from the SN 500-2000 class; and also aromatic hydrocarbons, paraffinic hydrocarbons and alkoxyalkanols. Also useful as a mineral carrier oil is a fraction which is obtained in the refining of mineral oil and is known as "hydrocrack oil" (vacuum distillate cut having a boiling range of from about 360 to 500° C., obtainable from natural mineral oil which has been catalytically hydrogenated under high pressure and isomerized and also deparaffinized).

Examples of suitable synthetic carrier oils are: polyolefins (poly-alpha-olefins or poly(internal olefin)s), (poly)esters, (poly)alkoxylates, polyethers, aliphatic polyether amines, alkylphenol-started polyethers, alkylphenol-started polyether amines and carboxylic esters of long-chain alkanols.

Examples of suitable polyolefins are olefin polymers, in particular based on polybutene or polyisobutene (hydrogenated or nonhydrogenated).

Examples of suitable polyethers or polyetheramines are preferably compounds comprising polyoxy-$C_2$-$C_4$-alkylene moieties which are obtainable by reacting $C_2$-$C_{60}$-alkanols, $C_6$-$C_{30}$-alkanediols, mono- or di-$C_2$-$C_{30}$-alkylamines, $C_1$-$C_{30}$-alkylcyclohexanols or $C_1$-$C_{30}$-alkylphenols with from 1 to 30 mol of ethylene oxide and/or propylene oxide and/or butylene oxide per hydroxyl group or amino group, and, in the case of the polyether amines, by subsequent reductive amination with ammonia, monoamines or polyamines. Such products are described in particular in EP-A-310 875, EP-A-356 725, EP-A-700 985 and U.S. Pat. No. 4,877,416. For example, the polyether amines used may be poly-$C_2$-$C_6$-alkylene oxide amines or functional derivatives thereof. Typical examples thereof are tridecanol butoxylates or isotridecanol butoxylates, isononylphenol butoxylates and also polyisobutenol butoxylates and propoxylates, and also the corresponding reaction products with ammonia.

Examples of carboxylic esters of long-chain alkanols are in particular esters of mono-, di- or tricarboxylic acids with long-chain alkanols or polyols, as described in particular in DE-A-38 38 918. The mono-, di- or tricarboxylic acids used may be aliphatic or aromatic acids; suitable ester alcohols or polyols are in particular long-chain representatives having, for example, from 6 to 24 carbon atoms. Typical representatives of the esters are adipates, phthalates, isophthalates, terephthalates and trimellitates of isooctanol, isononanol, isodecanol and isotridecanol, for example di-(n- or isotridecyl)phthalate.

Further suitable carrier oil systems are described, for example, in DE-A-38 26 608, DE-A-41 42 241, DE-A-43 09 074, EP-A-0 452 328 and EP-A-0 548 617, which are incorporated herein by way of reference.

Examples of particularly suitable synthetic carrier oils are alcohol-started polyethers having from about 5 to 35, for example from about 5 to 30, $C_3$-$C_6$-alkylene oxide units, for example selected from propylene oxide, n-butylene oxide and isobutylene oxide units, or mixtures thereof. Non-limiting examples of suitable starter alcohols are long-chain alkanols or phenols substituted by long-chain alkyl in which the long-chain alkyl radical is in particular a straight-chain or branched $C_6$-$C_{18}$-alkyl radical. Preferred examples include tridecanol and nonylphenol.

Further suitable synthetic carrier oils are alkoxylated alkylphenols, as described in DE-A-10 102 913.6.

Mixtures of mineral carrier oils, synthetic carrier oils, and mineral and synthetic carrier oils may also be used.

Any solvent and optionally co-solvent suitable for use in fuels may be used. Examples of suitable solvents for use in fuels include: non-polar hydrocarbon solvents such as kerosene, heavy aromatic solvent ("solvent naphtha heavy", "Solvesso 150"), toluene, xylene, paraffins, petroleum, white spirits, those sold by Shell companies under the trademark "SHELLSOL", and the like. Examples of suitable co-solvents include: polar solvents such as esters and, in particular, alcohols (e.g. t-butanol, i-butanol, hexanol, 2-ethylhexanol, 2-propyl heptanol, decanol, isotridecanol, butyl glycols, and alcohol mixtures such as those sold by Shell companies under the trade mark "LINEVOL", especially LINEVOL 79 alcohol which is a mixture of $C_{7-9}$ primary alcohols, or a $C_{12-14}$ alcohol mixture which is commercially available).

Dehazers/demulsifiers suitable for use in liquid fuels are well known in the art. Non-limiting examples include glycol oxyalkylate polyol blends (such as sold under the trade designation TOLAD™ 9312), alkoxylated phenol formaldehyde polymers, phenol/formaldehyde or $C_{1-18}$ alkylphenol/-formaldehyde resin oxyalkylates modified by oxyalkylation with $C_{1-18}$ epoxides and diepoxides (such as sold under the trade designation TOLAD™ 9308), and $C_{1-4}$ epoxide copolymers cross-linked with diepoxides, diacids, diesters, diols, diacrylates, dimethacrylates or diisocyanates, and blends thereof. The glycol oxyalkylate polyol blends may be polyols oxyalkylated with $C_{1-4}$ epoxides. The $C_{1-18}$ alkylphenol phenol/-formaldehyde resin oxyalkylates modified by oxyalkylation with $C_{1-18}$ epoxides and diepoxides may be based on, for example, cresol, t-butyl phenol, dodecyl phenol or dinonyl phenol, or a mixture of phenols (such as a mixture of t-butyl phenol and nonyl phenol). The dehazer should be used in an amount sufficient to inhibit the hazing that might otherwise occur when the gasoline without the dehazer contacts water, and this amount will be referred to herein as a "haze-inhibiting amount." Generally, this amount is from about 0.1 to about 20 ppmw (e.g. from about 0.1 to about 10 ppm), more preferably from 1 to 15 ppmw, still more preferably from 1 to 10 ppmw, advantageously from 1 to 5 ppmw based on the weight of the gasoline.

Further customary additives for use in gasolines are corrosion inhibitors, for example based on ammonium salts of organic carboxylic acids, said salts tending to form films, or of heterocyclic aromatics for nonferrous metal corrosion protection; antioxidants or stabilizers, for example based on amines such as phenyldiamines, e.g. p-phenylenediamine, N,N'-di-sec-butyl-p-phenyldiamine, dicyclohexylamine or derivatives thereof or of phenols such as 2,4-di-tert-butylphenol or 3,5-di-tert-butyl-4-hydroxy-phenylpropionic acid; anti-static agents; metallocenes such as ferrocene; methylcyclo-pentadienylmanganese tricarbonyl; lubricity additives, such as certain fatty acids, alkenylsuccinic esters, bis(hydroxyalkyl) fatty amines, hydroxyacetamides or castor oil; and also dyes (markers). Amines may also be added, if appropriate, for example as described in WO 03/076554. Optionally anti valve seat recession additives may be used such as sodium or potassium salts of polymeric organic acids.

The gasoline compositions herein can also comprise a detergent additive. Suitable detergent additives include those disclosed in WO2009/50287, incorporated herein by reference.

Preferred detergent additives for use in the gasoline composition herein typically have at least one hydrophobic hydrocarbon radical having a number-average molecular weight (Mn) of from 85 to 20 000 and at least one polar moiety selected from:

(A1) mono- or polyamino groups having up to 6 nitrogen atoms, of which at least one nitrogen atom has basic properties;

(A6) polyoxy-$C_2$- to -$C_4$-alkylene groups which are terminated by hydroxyl groups, mono- or polyamino groups, in which at least one nitrogen atom has basic properties, or by carbamate groups;

(A8) moieties derived from succinic anhydride and having hydroxyl and/or amino and/or amido and/or imido groups; and/or (A9) moieties obtained by Mannich reaction of substituted phenols with aldehydes and mono- or polyamines.

The hydrophobic hydrocarbon radical in the above detergent additives, which ensures the adequate solubility in the base fluid, has a number-average molecular weight (Mn) of from 85 to 20 000, especially from 113 to 10 000, in particular from 300 to 5000. Typical hydrophobic hydrocarbon radicals, especially in conjunction with the polar moieties (A1), (A8) and (A9), include polyalkenes (polyolefins), such as the polypropenyl, polybutenyl and polyisobutenyl radicals each having Mn of from 300 to 5000, preferably from 500 to 2500, more preferably from 700 to 2300, and especially from 700 to 1000.

Non-limiting examples of the above groups of detergent additives include the following:

Additives comprising mono- or polyamino groups (A1) are preferably polyalkenemono- or polyalkenepolyamines based on polypropene or conventional (i.e. having predominantly internal double bonds) polybutene or polyisobutene having Mn of from 300 to 5000. When polybutene or polyisobutene having predominantly internal double bonds (usually in the beta and gamma position) are used as starting materials in the preparation of the additives, a possible preparative route is by chlorination and subsequent amination or by oxidation of the double bond with air or ozone to give the carbonyl or carboxyl compound and subsequent amination under reductive (hydrogenating) conditions. The amines used here for the amination may be, for example, ammonia, monoamines or polyamines, such as dimethylaminopropylamine, ethylenediamine, diethylenetriamine, triethylenetetramine or tetraethylenepentamine. Corresponding additives based on polypropene are described in particular in WO-A-94/24231.

Further preferred additives comprising monoamino groups (A1) are the hydrogenation products of the reaction products of polyisobutenes having an average degree of polymerization of from 5 to 100, with nitrogen oxides or mixtures of nitrogen oxides and oxygen, as described in particular in WO-A-97/03946.

Further preferred additives comprising monoamino groups (A1) are the compounds obtainable from polyisobutene epoxides by reaction with amines and subsequent dehydration and reduction of the amino alcohols, as described in particular in DE-A-196 20 262.

Additives comprising polyoxy-$C_2$-$C_4$-alkylene moieties (A6) are preferably polyethers or polyetheramines which are obtainable by reaction of $C_2$- to $C_{60}$-alkanols, $C_6$- to $C_{30}$-alkanediols, mono- or di-$C_2$-$C_{30}$-alkylamines, $C_1$-$C_{30}$-alkylcyclohexanols or $C_1$-$C_{30}$-alkylphenols with from 1 to 30 mol of ethylene oxide and/or propylene oxide and/or butylene oxide per hydroxyl group or amino group and, in the case of the polyether-amines, by subsequent reductive amination with ammonia, monoamines or polyamines. Such products are described in particular in EP-A-310 875, EP-A-356 725, EP-A-700 985 and U.S. Pat. No. 4,877,416. In the case of polyethers, such products also have carrier oil properties. Typical examples of these are tridecanol butoxylates, isotridecanol butoxylates, isononylphenol butoxylates and polyisobutenol butoxylates and propoxylates and also the corresponding reaction products with ammonia.

Additives comprising moieties derived from succinic anhydride and having hydroxyl and/or amino and/or amido and/or imido groups (A8) are preferably corresponding derivatives of polyisobutenylsuccinic anhydride which are obtainable by reacting conventional or highly reactive polyisobutene having Mn of from 300 to 5000 with maleic anhydride by a thermal route or via the chlorinated polyisobutene. Of particular interest are derivatives with aliphatic polyamines such as ethylenediamine, diethylenetriamine, triethylenetetramine or tetraethylenepentamine. Such additives are described in particular in U.S. Pat. No. 4,849,572.

Additives comprising moieties obtained by Mannich reaction of substituted phenols with aldehydes and mono- or polyamines (A9) are preferably reaction products of polyisobutene-substituted phenols with formaldehyde and mono- or polyamines such as ethylenediamine, diethylenetriamine, triethylenetetramine, tetraethylenepentamine or dimethylaminopropylamine. The polyisobutenyl-substituted phenols may stem from conventional or highly reactive polyisobutene having Mn of from 300 to 5000. Such "polyisobutene-Mannich bases" are described in particular in EP-A-831 141.

Preferably, the detergent additive used in the gasoline compositions of the present invention contains at least one nitrogen-containing detergent, more preferably at least one nitrogen-containing detergent containing a hydrophobic hydrocarbon radical having a number average molecular weight in the range of from 300 to 5000. Preferably, the nitrogen-containing detergent is selected from a group comprising polyalkene monoamines, polyetheramines, polyalkene Mannich amines and polyalkene succinimides. Conveniently, the nitrogen-containing detergent may be a polyalkene monoamine.

In the above, amounts (concentrations, % vol, ppmw, % wt) of components are of active matter, i.e. exclusive of volatile solvents/diluent materials.

The liquid fuel composition of the present invention can be produced by admixing the essential one or more organic sunscreen compounds with a gasoline base fuel suitable for use in an internal combustion engine. Since the base fuel to which the essential fuel additive is admixed is a gasoline, then the liquid fuel composition produced is a gasoline composition.

It has been found that the use of one or more organic sunscreen compounds in liquid fuel compositions provides benefits in terms of improved power, improved acceleration and increased flame speed of an internal combustion engine being fuelled by the liquid fuel composition containing said organic sunscreen, relative to the internal combustion engine being fuelled by the liquid base fuel.

The present invention will be further understood from the following examples. Unless otherwise stated, all amounts and concentrations disclosed in the examples are based on weight of the fully formulated fuel composition.

EXAMPLES

A number of fully formulated fuel compositions were subjected to an automated power and acceleration Chassis Dynamometer test. The vehicle used was a 2.0 liter Hyundai Coupe with a multi-point injection (MPI) engine. For each fuel composition tested, engine performance was recorded to determine acceleration and power output under fixed conditions.

The sunscreen/UV absorber additives used in this example are detailed in Table 1 below.

TABLE 1

| Chemical Name: | Trade Name: |
|---|---|
| Octocrylene | Escalol 597; Parsol 340 |
| Ethylhecyl Salicylate | Escalol 587; Parsol EHS |
| Ethylhexyl Methoxycinnamate | Escalol 557; Parsol MCX |
| Butyl Methoxydibenzoylmethane | Escalol 517; Parsol 1789 |
| 4-methylbenzylidene camphor | Parsol 5000 |
| Oxybenzone | Escalol 567 |
| Ethylhexyl Dimethyl PABA | Escalol 507 |
| Phenethyl Benzoate | X-tend 226 |

All compounds with Parsol tradenames are supplied by DSM International. All compounds with Escalol and X-tend tradenames are supplied by Ashland.

Each test consisted of the following steps:

Step 1: 30 minutes minimum vehicle warm up at 100 kph 4 gear.

Step 2: Three EUDC cycles were conducted to stabilize operating temperatures.

Step 3: Fifteen consecutive accelerations were performed, from 30 to 120 kph in $4^{th}$ gear. The final five accelerations were measured and the average acceleration time calculated.

Step 4: Following the acceleration phase three steady state power measurements were performed at 50, 80 and 105 kph.

Step 5: The fuel was flushed/changed.

All fuel blends used the same base fuel (Fuel A in the tables below). The base fuel was an unleaded gasoline fuel meeting EN228, containing no ethanol and no performance additive. The properties of the base fuel are set out in Table 2 below.

TABLE 2

| Parameter | Method | Units | |
|---|---|---|---|
| Research Octane Number (RON) | ASTM D2699 | — | 96.4 |
| Motor Octane Number (MON) | ASTM D 2700 | — | 85.1 |
| Density at 15° C. | IP 365 | g $cm^{-3}$ | 0.7426 |
| Gum | | | |
| Unwashed gum | IP 131 | mg/100 ml | 1 |
| Distillation | IP 123 | | |
| IBP | | ° C. | 28.6 |
| 10% rec | | ° C. | 47.3 |
| 20% rec | | ° C. | 59.3 |
| 30% rec | | ° C. | 71.6 |
| 40% rec | | ° C. | 84.9 |
| 50% rec | | ° C. | 98.1 |
| 60% rec | | ° C. | 109.5 |
| 70% rec | | ° C. | 120.6 |
| 80% rec | | ° C. | 134.1 |
| 90% rec | | ° C. | 152.4 |
| 95% rec | | ° C. | 168.2 |
| FBP | | ° C. | 198.5 |
| Residue | | % vol | 0.8 |
| Recovery | | % vol | 96.8 |
| Loss | | % vol | 2.4 |
| E70 | | % vol | 28.8 |
| E100 | | % vol | 51.6 |
| E120 | | % vol | 69.4 |
| E150 | | % vol | 88.7 |
| E180 | | % vol | 97.1 |
| E120-E70 | | % vol | |
| RVP | IP 394/ ASTM 5191 | kPa | 72.9 |
| Sulphur WD-XRF | ISO 20884 | mg/kg | 7 |

The sunscreen additives were individually added into the base fuel at treat rates of 0.5% and 1%. Table 3 below shows the % increase in acceleration over the base fuel for each of the fuel compositions tested. Table 3 also shows the % increase in power over the base fuel at various kph. In Table 3 below a negative number means that a decrease in acceleration/power over the base fuel was observed.

There were 2 fuel blends prepared which contained a combination of 2 sunscreen additives. Table 4 shows the results for these 2 fuel blends, in terms of % increase in acceleration and power over the base fuel.

TABLE 3

| | Treat Rate = 0.50% | | | | | Treat Rate = 1% | | | | |
|---|---|---|---|---|---|---|---|---|---|---|
| Organic Sunscreen: | Acceleration | Power at 30 kph | Power at 50 kph | Power at 80 kph | Power at 105 kph | Acceleration | Power at 30 kph | Power at 50 kph | Power at 80 kph | Power at 105 kph |
| EHDPABA | 0.2 | 0.31 | 0.14 | 0.30 | 0.22 | 0.30 | 0.77 | 0.22 | 0.25 | 0.1 |
| BMDBM | 0.23 | 0.40 | 0.08 | 0.13 | 0.20 | 0.29 | 0.40 | 0.38 | 0.21 | 0.26 |
| OC | 0.19 | 0.26 | 0.11 | 0.02 | 0.16 | 0.34 | 0.46 | 0.34 | 0.42 | 0.23 |
| MBC | 0.21 | 0.08 | 0.24 | 0.1 | 0.32 | 0.14 | 0.08 | 0.17 | 0.11 | 0.09 |
| EHMOC | 0.09 | 0.27 | 0.00 | 0.21 | 0.07 | 0.22 | 0.26 | 0.01 | −0.06 | 0.06 |

TABLE 3-continued

| Organic Sunscreen: | Treat Rate = 0.50% Acceleration | Power at 30 kph | Power at 50 kph | Power at 80 kph | Power at 105 kph | Treat Rate = 1% Acceleration | Power at 30 kph | Power at 50 kph | Power at 80 kph | Power at 105 kph |
|---|---|---|---|---|---|---|---|---|---|---|
| OB | 0.05 | 0.04 | −0.10 | −0.03 | 0.10 | 0.16 | 0.26 | 0.22 | 0.00 | 0.03 |
| PEB | ND | ND | ND | ND | ND | 0.13 | 0.35 | 0.06 | 0.11 | 0.05 |
| EHS | 0.22 | 0.05 | 0.13 | 0.17 | 0.09 | 0.02 | 0.26 | −0.22 | −0.05 | 0.00 |

ND = not determined

TABLE 4

| Organic Sunscreen and treat rate: | Acceleration | Power at 30 kph | Power at 50 kph | Power at 80 kph | Power at 105 kph |
|---|---|---|---|---|---|
| 0.5% EHDPABA + 0.5% BMDBM | 0.2% | 0.31% | 0.14% | 0.30% | 0.22% |
| 0.5% EHDPABA + 0.5% EHMOC | 0.23% | 0.40% | 0.08% | 0.13% | 0.20% |

DISCUSSION

As can be seen from the overall results in Tables 3 and 4, the inclusion of organic sunscreens at treat rates of 0.5 wt % and 1 wt % in a base fuel provides benefits in terms of increased acceleration over a base fuel not containing any organic sunscreens. In addition, it can also be seen from the overall results in Tables 3 and 4 that the inclusion of organic sunscreens at treat rates of 0.5 wt % and 1 wt % in a base fuel provides benefits in terms of increased power output at various kphs compared to a base fuel not containing organic sunscreens.

What is claimed is:

1. A liquid fuel composition comprising:

(a) a gasoline base fuel suitable for use in an internal combustion engine; and (b) one or more organic sunscreen compounds selected from the group consisting of diethanolamine methoxycinnamate, 4-methylbenzylidene camphor, phenethyl benzoate, and mixtures thereof.

2. The liquid fuel composition of claim 1 wherein the total level of the one or more organic sunscreen compounds is in the range of from 10 ppmw to 2 wt %, by weight of the liquid fuel composition.

3. The liquid fuel composition of claim 2 wherein the sunscreen compound comprises diethanolamine methoxycinnamate.

4. The liquid fuel composition of claim 2 wherein the sunscreen compound comprises 4-methylbenzylidene camphor.

5. The liquid fuel composition of claim 2 wherein the sunscreen compound comprises phenethyl benzoate.

6. A method of improving the acceleration of an internal combustion engine, said method comprising fuelling the internal combustion engine containing a liquid fuel composition of claim 1.

* * * * *